US012704339B2

(12) United States Patent
Delgado Acarreta et al.

(10) Patent No.: US 12,704,339 B2
(45) Date of Patent: Aug. 11, 2026

(54) SEAR ASSEMBLY FOR WEAPONS

(71) Applicant: Rade Tecnologías, S.L., Saragossa (ES)

(72) Inventors: Raúl Delgado Acarreta, Saragossa (ES); Diego Ibáñez Martínez, Saragossa (ES); Lucas Serrano Portilla, Saragossa (ES); Diego Lorente Algora, Saragossa (ES)

(73) Assignee: Rade Tecnologías, S.L., Saragossa (ES)

( * ) Notice: Subject to any disclaimer, the term of this patent is extended or adjusted under 35 U.S.C. 154(b) by 0 days.

(21) Appl. No.: 19/194,015

(22) Filed: Apr. 30, 2025

(65) Prior Publication Data

US 2025/0334369 A1 Oct. 30, 2025

(30) Foreign Application Priority Data

Apr. 30, 2024 (EP) ..... 24382478

(51) Int. Cl.
*F41A 19/59* (2006.01)
*F41A 17/56* (2006.01)
*F41A 19/64* (2006.01)

(52) U.S. Cl.
CPC ..... *F41A 19/59* (2013.01); *F41A 17/56* (2013.01); *F41A 19/64* (2013.01)

(58) Field of Classification Search
CPC ..... F41A 19/59; F41A 19/64; F41A 17/56
See application file for complete search history.

(56) References Cited

U.S. PATENT DOCUMENTS

| | | | | |
|---|---|---|---|---|
| 5,485,776 | A * | 1/1996 | Ealovega | F41A 19/03 89/135 |
| 5,713,150 | A | 2/1998 | Ealovega | |
| 6,568,381 | B2 * | 5/2003 | Chang | F41A 19/59 124/66 |
| 6,626,165 | B1 * | 9/2003 | Bhogal | F41A 19/59 124/76 |
| 8,807,007 | B2 * | 8/2014 | Alicea | F41A 19/59 89/28.1 |
| 9,151,559 | B2 * | 10/2015 | Alicea, Jr. | F41A 19/69 |
| 9,658,017 | B2 * | 5/2017 | Alicea | F41A 19/59 |
| 10,508,876 | B2 * | 12/2019 | Alicea, Jr. | F41A 17/56 |
| 10,724,816 | B2 * | 7/2020 | Alicea, Jr. | F41A 17/22 |
| 10,731,938 | B2 * | 8/2020 | Alicea, Jr. | F41A 3/66 |
| 10,866,049 | B2 * | 12/2020 | Werner | F41A 19/08 |
| 11,846,478 | B2 * | 12/2023 | Kloepfer | F41A 19/59 |
| 11,898,814 | B2 * | 2/2024 | Alicea, Jr. | F41A 17/56 |
| 12,326,307 | B2 * | 6/2025 | Roth | F41A 19/64 |
| 2016/0084601 | A1 * | 3/2016 | Alicea, Jr. | F41A 19/10 42/6 |

(Continued)

*Primary Examiner* — Michelle Clement
(74) *Attorney, Agent, or Firm* — S.J INTELLECTUAL PROPERTY LTD.

(57) ABSTRACT

A sear assembly for a weapon, the weapon comprising a hammer adapted to contact with the sear assembly and a trigger disconnected from the sear assembly, the sear assembly comprises a sear for mechanically engaging a sear surface on the hammer, a lever mechanically coupled by one end to the sear, the lever comprising a contact surface that causes the rotation of the sear, an actuator that actuates the lever by means of a cam, and a trigger sensor that is configured to determine if the trigger is pulled. In this regard, the trigger sensor is a coil. The sear assembly comprises a firing state and a safe state.

20 Claims, 13 Drawing Sheets

(56) References Cited

U.S. PATENT DOCUMENTS

| | | | | |
|---|---|---|---|---|
| 2016/0377364 | A1* | 12/2016 | Santos Reis | F41A 19/58<br>89/135 |
| 2018/0245869 | A1* | 8/2018 | Marin Tomás | F41A 19/59 |
| 2019/0346622 | A1 | 11/2019 | Shneorson | |
| 2025/0334369 | A1* | 10/2025 | Delgado Acarreta | F41A 19/59 |

* cited by examiner

VIA-VIA'

VIB-VIB'

VIIIA-VIIIA'

VIIIB-VIIIB'

VIIIC-VIIIC'

SEAR ASSEMBLY FOR WEAPONS

FIELD OF THE INVENTION

The present invention relates to sear assemblies for firing weapons.

Particularly, the object of the present invention is to provide a sear assembly and an electromechanical firing mechanism for a firing weapon as well as a method for selecting between a firing state and a safe state using the proposed sear assembly according to the present invention.

BACKGROUND OF THE INVENTION

Conventional sear assemblies for firing weapons either in automatic mode or semi-automatic mode do not allow remote control as they consist in mechanical devices that require the user to manually actuate them.

Patent document U.S. Pat. No. 5,713,150 relates to a weapon mechanism comprising a hammer, means for semi-automatic firing, and means for automatic firing. The means for semi-automatic firing has a trigger with a first sear abutment for engaging a first sear surface on the hammer and a disconnector. The disconnector is movably connected to the trigger and has a sear abutment for engaging a second sear surface on the hammer. The means for automatic firing has an electro-mechanically movable actuator. The actuator is for moving an automatic sear out of engagement with a third sear surface on the hammer. The automatic firing means is only operable after the trigger releases the hammer from mechanical engagement at the first sear surface.

The use of several sears for firing in both, the semiautomatic and automatic mode, makes it easy for the weapon to stop working properly. Moreover, the force required to perform transition of the weapon from a firing state to a safe state and vice versa may be considerably high as well as the wear suffered by the mechanical parts of the sear assemblies. In contrast, the speed transition from firing state to a safe state and vice versa tend to be slow as it fully depends on the mechanical response of the conventional safety mechanism.

Patent document U.S. Pat. No. 5,770,814 disclose various techniques for controlling the firing rate of an automatic weapon by controlling the movement of the bolt of the weapon. The movement rate of the bolt carrier assembly and hammer, which controls the fire rate in, are set by the mechanical mechanism designed by the manufacturer of the weapon. Therefore, the automatic firing rate of a weapon is typically set by the physical characteristics of its mechanical mechanism.

Patent document U.S. Ser. No. 10/845,148 describes a firing control apparatus and a method for installing in a firearm, wherein the apparatus comprises an energy storing mechanism configured to store mechanical energy which is produced by a mechanical system, upon firing the firearm or by manual operation of the firearm, an electromagnet configured to control the energy storing mechanism, wherein the energy storing mechanism holds or releases the mechanical energy to prevent or enable the firearm from firing, and a processor or an electro-mechanical switch configured to activate or deactivate the electromagnet to control the operation of the energy storing mechanism according to preselected rules. This document presents a very complex solution and with very high energy consumption.

Patent document US2021148665 relates to a trigger for a weapon, the weapon comprising a sear disconnected from the trigger, the trigger comprises a lever mechanically coupled by one end to the trigger, the lever comprising a contact surface that causes rotation of the sear, a carrier, an actuator that actuates the carrier, a first magnetic element established on the lever and a second magnetic element established on the carrier, wherein at least the first magnetic element or the second magnetic element is a magnet or an electromagnet, wherein the trigger comprises a firing state and a safe state.

This document presents a solution with high vulnerability to external electromagnetic fields which could disrupt the system's operation, especially problematic in environments with numerous electromagnetic sources.

Hence, a solution for at least the mentioned drawbacks given by the conventional sear assemblies for firing weapons is desired.

SUMMARY OF THE INVENTION

The present invention relates to a sear assembly for firing weapons.

In the context of the present invention, by weapon it is meant any small arm or light weapon, such as a firearm, gun, shotgun, airgun, machine gun, pistol, rifle, revolver, etc. and also non-lethal weapon or archery weapon.

In the context of the present invention, by sear it is meant any part of the firing mechanism of a weapon between the trigger and the hammer. Optionally, the sear may be an auto-sear of the weapon.

In the context of the present invention, when we refer to left side or right side of the weapon, we refer to it from the shooter point of view while firing, being the barrel of the weapon the front part and the backstrap of the weapon the back part.

In the context of the present invention, when we refer to clockwise or counterclockwise direction, we refer to it looking to the weapon from left side of the weapon.

The electromechanical sear assembly for weapons comprises a sear assembly wherein a transition from a firing state (or mode) to a safe state (or mode) is made by interposition of the kinematic shooting chain by means of a sear that engages the hammer, both in the semiautomatic and automatic mode. For this purpose, a conventional sear mechanism is modified to perform its original function (firing state) or not (safe state) in both the semiautomatic and the automatic mode. Conventionally, in the semiautomatic mode, the trigger retains the hammer while trigger is not pulled. Once the trigger is pulled and the weapon has fired a shot, the disconnector retains the hammer while the trigger is being pulled, as can be seen as an example on cited in the background patent document U.S. Pat. No. 5,713,150. Once the shooter releases the trigger, the disconnector releases the hammer, but the trigger retains it, impeding the release of a new shot. When the shooter pulls again the trigger, a new shot will be fired. In the automatic mode, as in the semiautomatic mode, the trigger retains the hammer while trigger is not pulled. Once the trigger is pulled and the weapon has fired a shot, the sear (preferably an auto-sear) controls the release hammer, controlling the release of additional shots. Again, when the shooter releases the trigger, the trigger retains the hammer.

As it has been described, both in the semiautomatic and the automatic mode an element of the kinematic shooting chain controls the hammer when the trigger is pulled (disconnector in the semiautomatic mode, impeding the release of the hammer until the trigger is released, time when the trigger retains the hammer, and sear in the automatic mode allowing or impeding the release of the hammer). Then, what this invention suggests is the use of an only sear for both, the automatic and semiautomatic mode, improving the kinematic shooting chain of the weapon and reducing the risk of mechanical fail. Therefore, by controlling the interaction between the sear and the hammer, it is possible to control the safe or firing state or mode of the weapon in addition and independent of the original weapon safeties.

Moreover, by using a trigger sensor in order to determine if the trigger is pulled, it is possible to control the release of shots by means of an actuator and without physical connection between the trigger and the sear assembly. This presents lots of advantages such as minimizing the risk of mechanical failures, control the force required to perform transition of the weapon from a firing state to a safe state, and vice versa, and so on.

Therefore, according to a first aspect of the present invention, as claimed in claim 1, it is proposed a sear assembly for a weapon, the weapon comprising a hammer adapted to contact with the sear assembly and a trigger disconnected from the sear assembly, the sear assembly comprises a sear for mechanically engaging a sear surface on the hammer, a lever mechanically coupled by one end to the sear, the lever comprising a contact surface that causes the rotation of the sear, an actuator that actuates the lever by means of a cam, and a trigger sensor that is configured to determine if the trigger is pulled. In this regard, the trigger sensor comprises a coil.

Hence, the sear assembly comprises a firing state, wherein the actuator actuates the lever by means of the cam such that the contact surface of the lever causes the rotation of the sear in a counterclockwise direction, such that the sear disengages the sear surface on the hammer allowing at least a shot to be fired when pulling the trigger.

Hence, the sear assembly comprises a safe state, wherein the actuator actuates the lever by means of the cam such that the contact surface of the lever causes the rotation of the sear in a clockwise direction, such that the sear engages the sear surface on the hammer impeding a shot to be fired when pulling the trigger.

In some examples, the sear assembly further comprises a selector operable at least between the firing state and the safe state of the sear assembly. In some examples, the sear assembly further comprises a selector sensor for identifying the position of the selector. In some examples, the selector sensor comprises a coil. In some examples, the trigger sensor and/or the selector sensor further comprises a coil core of a ferromagnetic material, preferably steel. In some examples, the trigger sensor and/or the selector sensor are at least partially located in a grip of the weapon.

Optionally, and in addition to the previous advantages, when the proposed invention adds a selector sensor for identifying the position of the selector, as an exemplary embodiment knowing if the weapon is in the safe state, or firing state, and more particularly, a semiautomatic firing state or in the automatic firing state, the proposed invention allows to control the release of shots in both, the semiautomatic and the automatic firing state. A particularly important advantage of the present invention is that it allows, by controlling the interaction between the sear and the hammer, to control and/or reduce the firing rate of the weapon.

The use of a coil as trigger or selector sensor presents lots of advantages. The reduced size of the sensor is one of the most important advantages of using this kind of sensor. Weapons have small spaces to allocate many mechanical parts, such as the kinematic shooting chain. Using a sensor with small size allows to integrate it in the weapon without problems. One of the zones of the weapon where usually there are more space to locate sensors is the grip, since it is a part the weapon where there are no critical elements of the kinematic shooting chain. Another important advantage of using a coil as a sensor is its low power consumption, since they are passive components that do not require an external power source to function as sensors. This low power consumption is advantageous in applications where energy efficiency is crucial, such as in battery-powered devices. Moreover, its robustness is another critical aspect of this kind of sensor. Coils can be constructed to be quite robust and resistant to adverse environmental conditions such as vibrations, extreme temperatures, humidity, and so on. This characteristic is critical in the world of weapons due to the large shocks that the weapon suffers when firing a shot. Another important aspect of using a coil as a sensor is its fast response because coils can detect changes in magnetic fields almost instantaneously, making them suitable for applications requiring a rapid response, such as in weapon systems. Lastly, another advantage is its non-contact operation, because as they operate by detecting magnetic fields, coils can detect objects without the need for direct physical contact, making them ideal for applications requiring frictionless or wear-free measurement, as in the invention described.

The use of a coil core made of a ferromagnetic material, such as steel, in the trigger sensor and/or the selector sensor offers several advantages, such as its increased sensitivity, because ferromagnetic materials have high magnetic permeability, which enhances the sensitivity of the sensor to changes in magnetic fields. This increased sensitivity allows for more precise detection of magnetic signals, improving the overall performance of the sensor. Another advantage is its improved signal-to-noise ratio, because the use of a ferromagnetic core helps to concentrate and amplify magnetic fields, leading to a stronger signal relative to background noise. This results in a better signal-to-noise ratio, making it easier to detect and distinguish the desired signal from interference. Other advantages are its stability and repeatability, a wide operating range and its mechanical robustness.

In some examples, the sear assembly further comprises means for identifying the position of the cam. In some examples, the means for identifying the position of the cam comprises one or more magnetic field sensors, preferably hall sensors, associated with one or more magnetic elements established on the cam, preferably magnets or electromagnets. In some examples, the actuator is a motor or an electromagnet. In some examples, the actuator is located in the grip of the weapon.

The main advantages of using magnetic field sensor and magnetic elements for identifying the position of the cam are its low power consumption, its fast response time, its high sensitivity and that it is a non-contact sensing.

In some examples, the cam comprises at least two lobes. In some examples, the means for identifying the state of the cam comprises a stepper motor, a mechanical switch or mechanical stoppers.

Using a cam with two lobes has the advantage of making the actuator to work properly, so that it is not overloaded.

In some examples, the cam and/or the lever are at least partially located in the grip of the weapon. In some examples, the sear is an auto-sear.

In some examples, the sear comprises an elastic element, preferably a torsion spring, which biases the sear in the clockwise direction, such that, by default, the sear engages the sear surface on the hammer impeding a shot to be fired when pulling the trigger.

This optional configuration has the advantage that in case of failure in the actuator, the weapon will be, as early as possible, in safe state, being an important safety measure.

In some examples, the sear is located in a lower receiver of the weapon.

Optionally, when a round is fired, some of the gases that are emitted during the combustion of the gunpowder are directed to push a bolt carrier assembly within the weapon, which cocks the hammer of the weapon. This is part of the state of the art as described, as an example, in patent document U.S. Ser. No. 10/845,148.

Another aspect of the present invention relates to the use of the sear mechanism according to the first aspect of the present invention for firing a weapon in an automatic mode, according to claim 11, and the use of the sear assembly for firing a weapon in a semi-automatic mode, according to claim 12.

Another aspect of the present invention, according to claim 13, relates to an electromechanical firing mechanism for a weapon, the electromechanical firing mechanism comprising the sear assembly according to the first aspect of the present invention, electronics comprising selection means for performing selection between the firing state and the safe state of the sear assembly, a processing unit to control the actuator based on said selection and a battery.

In some examples, the electronics further comprise light indicators, preferably a firing mode indicator, a communication indicator and an error or warning indicator. In some examples, the selection means comprises an actuator switch or a touch screen.

Another aspect of the present invention, according to claim 14, relates to a weapon comprising the sear assembly or the electromechanical firing mechanism according to the first aspect of the present invention.

A final aspect of the present invention, according to claim 15, relates to a method for selecting between a firing state or a safe state of a sear assembly for a weapon, the weapon comprising a hammer adapted to contact with the sear assembly and a trigger disconnected from the sear assembly, the sear assembly comprising a sear for mechanically engaging a sear surface on the hammer, a lever mechanically coupled by one end to the sear, the lever comprising a contact surface that causes the rotation of the sear, an actuator that actuates the lever by means of a cam, and a trigger sensor that is configured to determine if the trigger is pulled, wherein the trigger sensor comprises a coil.

The method comprises a first step for selecting the firing state of the sear assembly, wherein in the firing state, the actuator actuates the lever by means of the cam such that the contact surface of the lever causes the rotation of the sear in a counterclockwise direction, such that the sear disengages the sear surface on the hammer allowing at least a shot to be fired when pulling the trigger.

The method further comprises a second step for selecting the safe state of the sear assembly, wherein in the safe state, the actuator actuates the lever by means of the cam such that the contact surface of the lever causes the rotation of the sear in a clockwise direction, such that the sear engages the sear surface on the hammer impeding a shot to be fired when pulling the trigger.

The different aspects and embodiments of the invention defined in the foregoing can be combined with one another, as long as they are compatible with each other.

Additional advantages and features of the invention will become apparent from the detailed description that follows and will be particularly pointed out in the appended claims.

BRIEF DESCRIPTION OF THE DRAWINGS

For the purpose of aiding the understanding of the characteristics of the invention, according to a preferred practical embodiment thereof and in order to complement this description, the following figures are attached as an integral part thereof, having an illustrative and non-limiting character.

DETAILED DESCRIPTION OF THE INVENTION

A detailed description of the sear assembly, the electromechanical firing mechanism for a firing weapon, as well as a method for selecting between a firing state and a safe state using the proposed sear assembly according to the present invention.

As previously described, in the context of the present invention, when we refer to left side or right side of the weapon, we refer to it from the shooter point of view while firing, being the barrel of the weapon the front part and the backstrap of the weapon the back part.

Moreover, in the context of the present invention, when we refer to clockwise or counterclockwise direction, we refer to it looking to the weapon from left side of the weapon.

Figure 1:
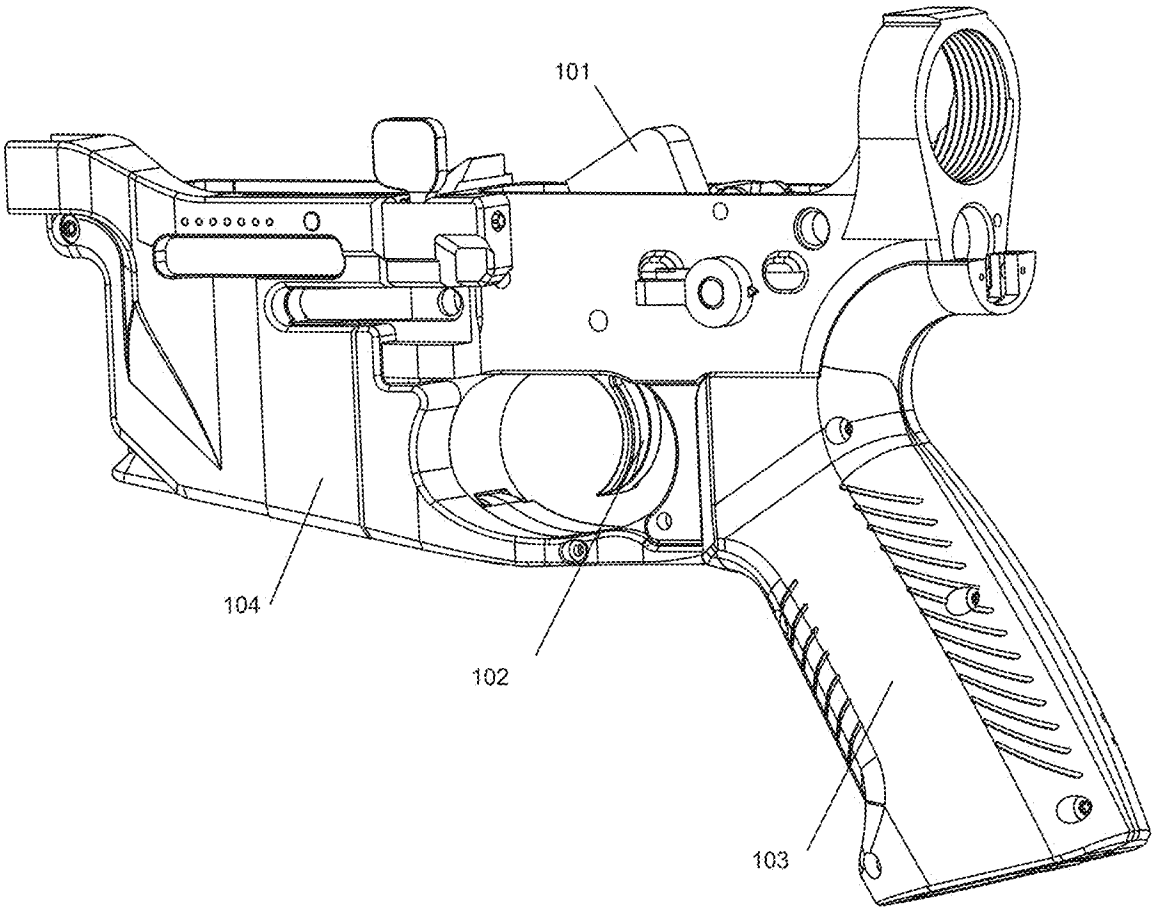
FIG. 1 shows an example of a grip and a lower receiver for a weapon on which the sear assembly of the invention can be mounted.
Figure 2A:
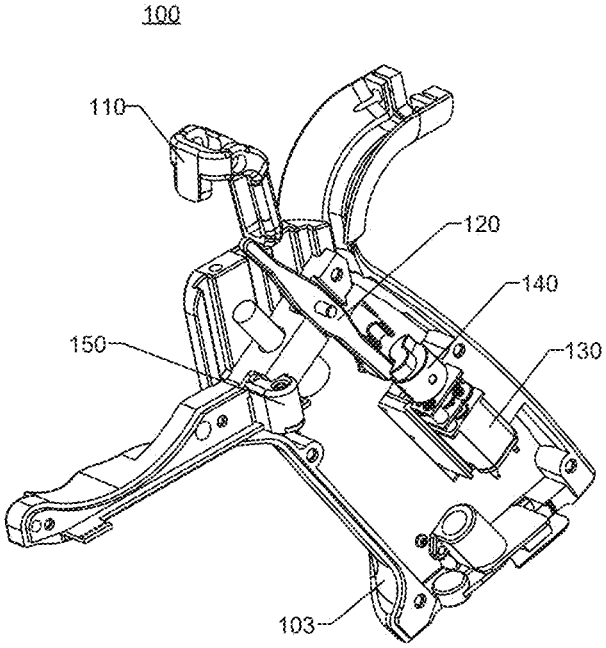
FIGS. 2A and 2B show the internal part of the grip and the main components of sear assembly according to the present invention, from the left side and the right side of the weapon, respectively.
Figure 2B:
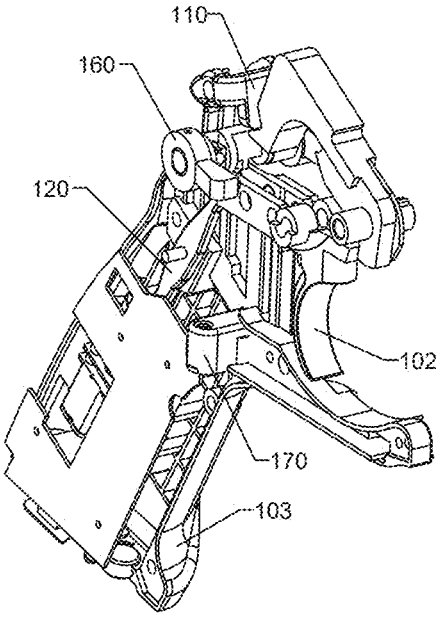

FIG. 1 shows an example of a grip (103) and a lower receiver (104) for a weapon on which the sear assembly (100) of the invention can be mounted. Also, a trigger (102) and a hammer (101) are shown. FIGS. 2A-B show the internal part of the grip (103) for illustrative purposes and the main components of the sear assembly (100) of the invention. FIG. 2A is a view from the left side of the weapon and FIG. 2B is a view from the right side of the weapon, both being, the barrel the front part of the weapon, and the backstrap the back part.

As shown in FIGS. 1 to 4, the proposed sear assembly (100) comprises a sear (110) for mechanically engaging a sear surface (110*a*) on the hammer (101), a lever (120) mechanically coupled by one end to the sear (110), the lever (120) comprising a contact surface (120*a*) that causes the rotation of the sear (110), an actuator (130) that actuates the lever (120) by means of a cam (140), and a trigger sensor (150) that is configured to determine if the trigger (102) is pulled. As can be seen as an example in FIGS. 2A, 5 and 6, the trigger sensor (150) comprises a coil.

Figure 3A:
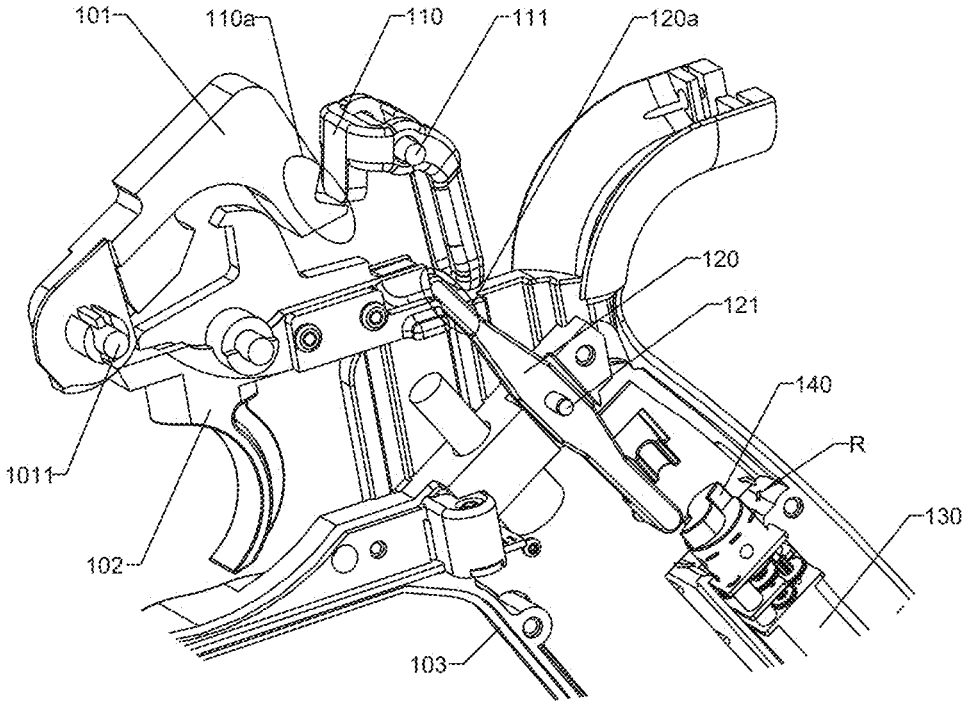
FIGS. 3A and 3B are exploded perspective views of some of the elements of the sear assembly of the present invention, according to a preferred embodiment.
Figure 3B:
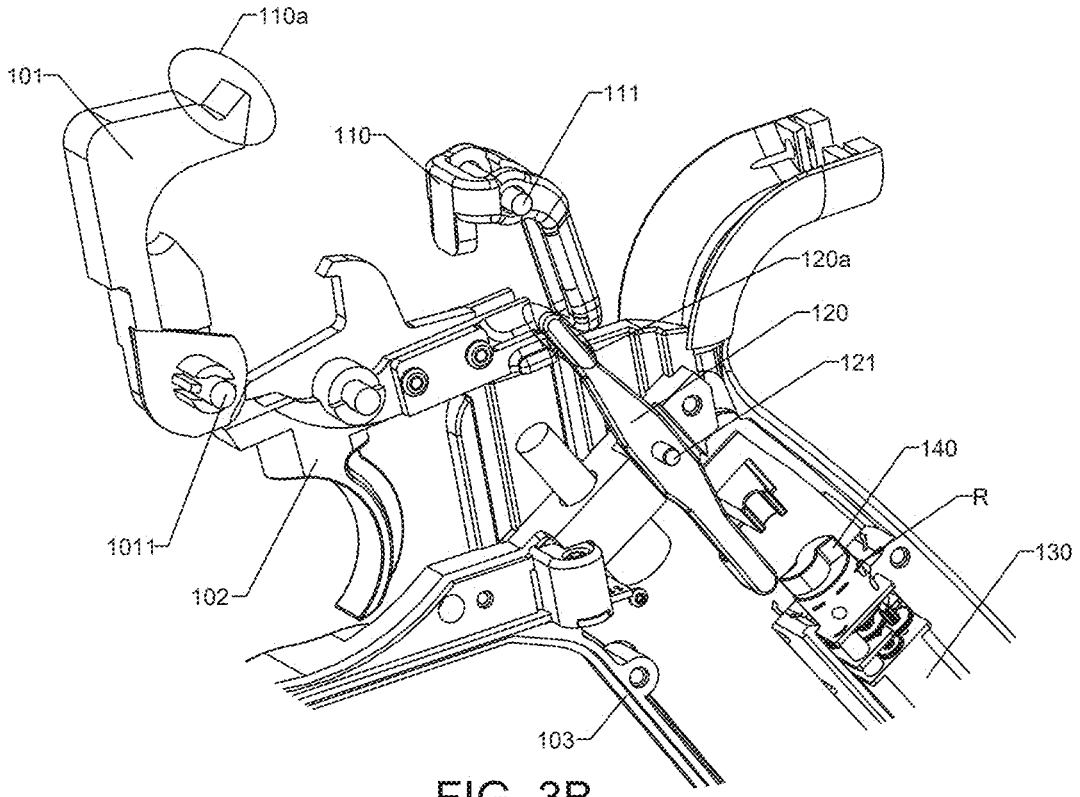
Figure 4A:
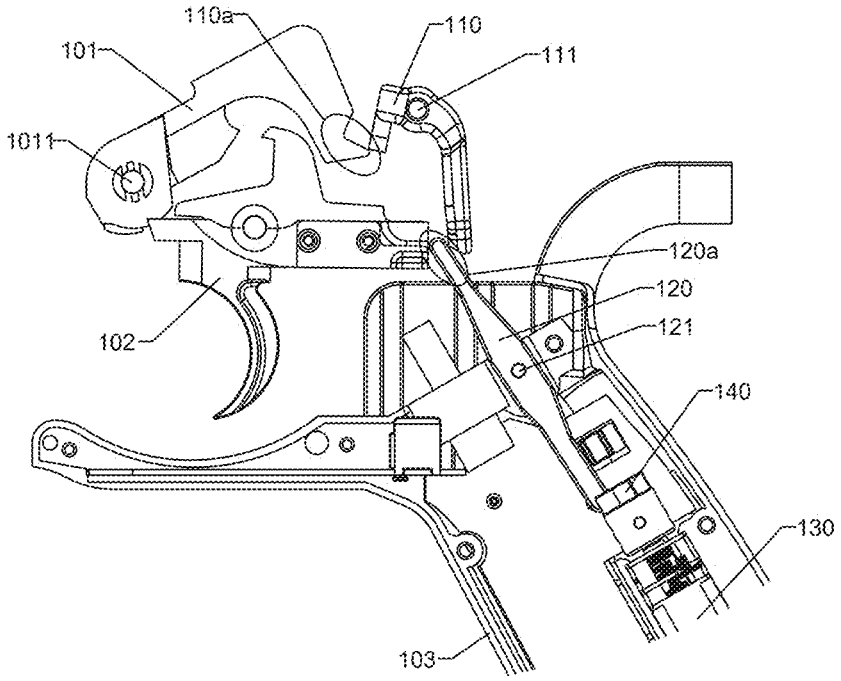
FIGS. 4A and 4B show left side views of some of the elements of the sear assembly of the present invention, according to a preferred embodiment.
Figure 4B:
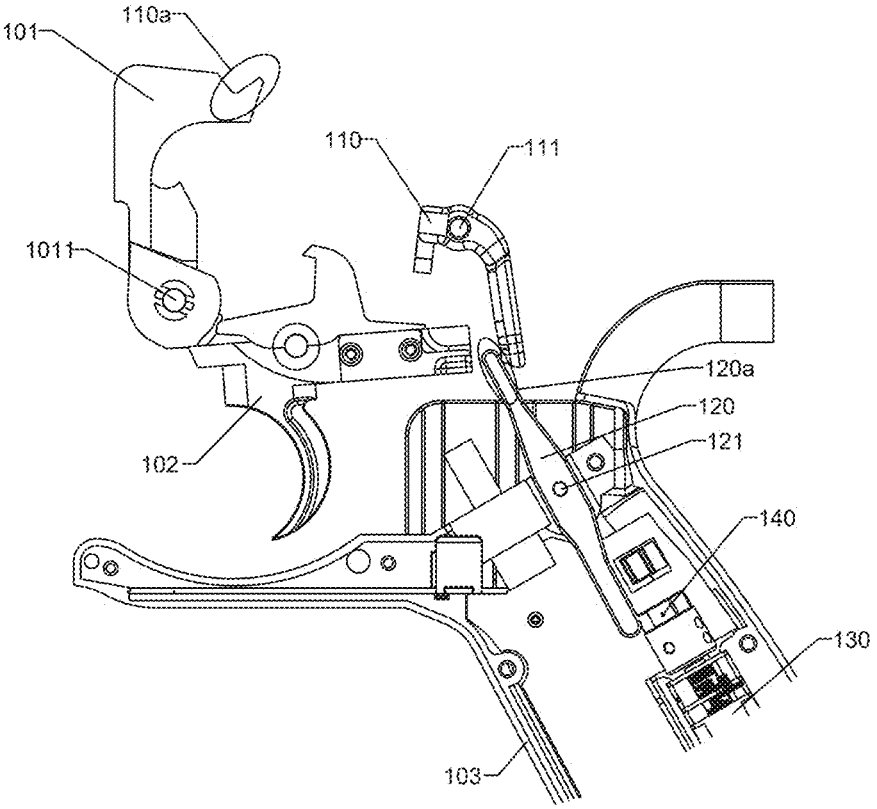

FIGS. 3 and 4 shows some of the elements of the sear assembly (100) of the present invention in a safe state (FIGS. 3A and 4A), and a firing state (FIGS. 3B and 4B). FIGS. 3A and 3B are exploded perspective views of sear assembly (100) of the present invention from the left side of the weapon, while FIGS. 4A and 4B are left side views of the sear assembly (100) of the present invention.

FIGS. 3A and 4A shows the safe state of the sear assembly (100), wherein the actuator (130) actuates the lever (120) by means of the cam (140) such that the contact surface (120*a*) of the lever (120) causes the rotation of the sear (110) in a clockwise direction, such that the sear (110) engages the sear surface (110*a*) on the hammer (101) impeding a shot to be fired when pulling the trigger (102).

FIGS. 3B and 4B shows the firing state of the sear assembly (100), wherein the actuator (130) actuates the lever (120) by means of the cam (140) such that the contact surface (120*a*) of the lever (120) causes the rotation of the sear (110) in a counterclockwise direction, such that the sear (110) disengages the sear surface (110*a*) on the hammer (101) allowing at least a shot to be fired when pulling the trigger (102).

As can be seen in FIGS. 3 and 4, the actuator (130), which in a preferred embodiment is a motor located in the grip (103) of the weapon, causes the rotation of the cam (140) in the direction of rotation (R), visible in FIGS. 3A and 3B, which is preferably perpendicular to a shaft (121) of the lever (120). The rotation of the cam (140) causes, by direct physical contact, the rotation of the lever (120) around its shaft (121) in a counterclockwise direction (safe state) or a clockwise direction (firing state). The rotation of the lever (120) causes, through the contact surface (120*a*) of the lever (120), the rotation of the sear (110) around a shaft (111), parallel to the shaft (121) of the lever (120), in a clockwise direction (safe state) or a counterclockwise direction (firing state), which, in turn, through the sear surface (110*a*) on the hammer (101), impedes (safe state) or allows (firing state) the rotation of the hammer (101) around a shaft (1101), parallel to the shaft (111) of the sear (110), impeding (safe state) or allowing (firing state) a shot to be fired.

It is extremely important to know if the trigger is pulled in order to allow (firing state) or impede (safe state) a shot to be fired, reducing the risk of accidents.

Figure 5A:
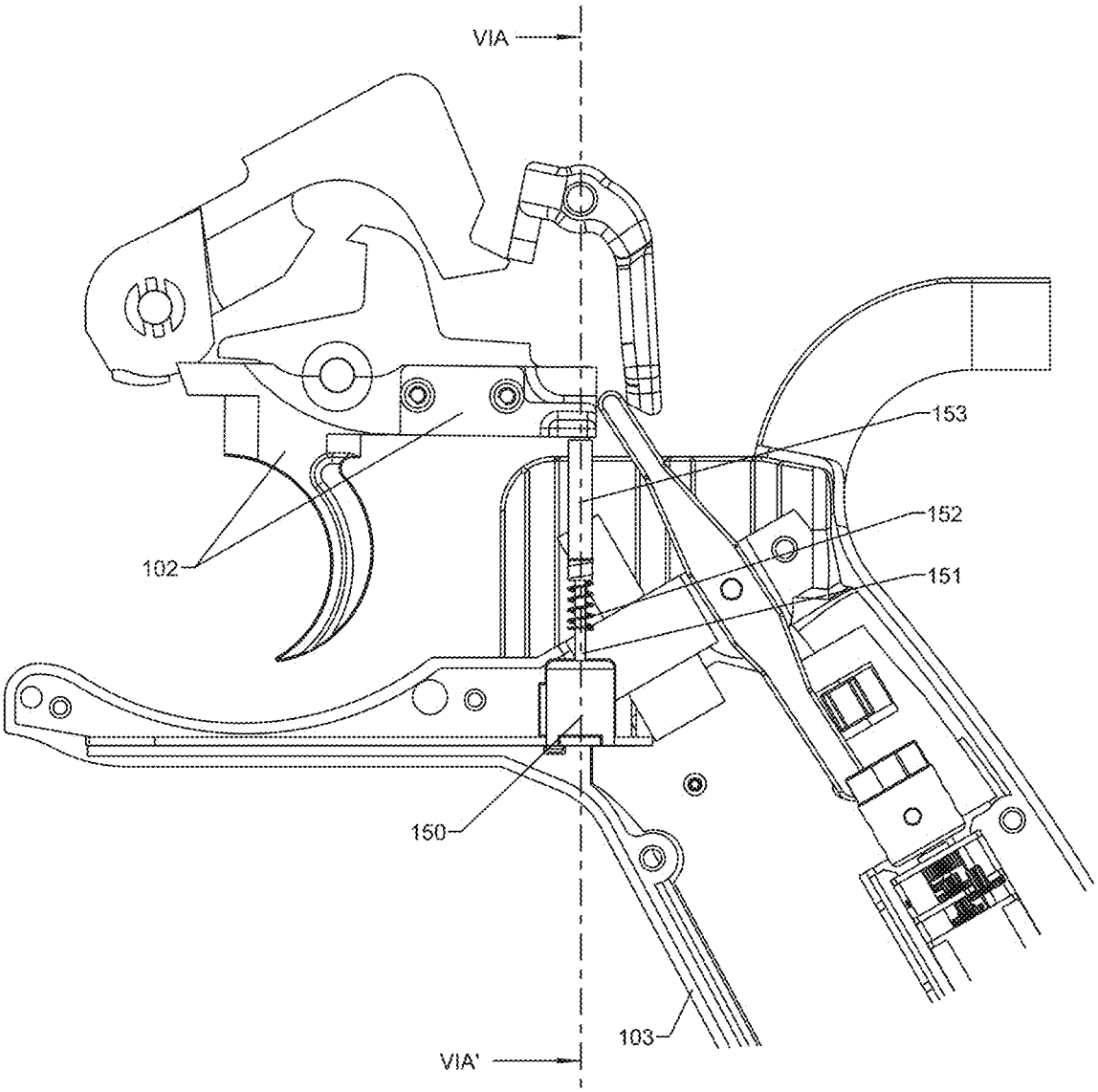
FIGS. 5A and 5B show left side views of the trigger sensor of the present invention.
Figure 5B:
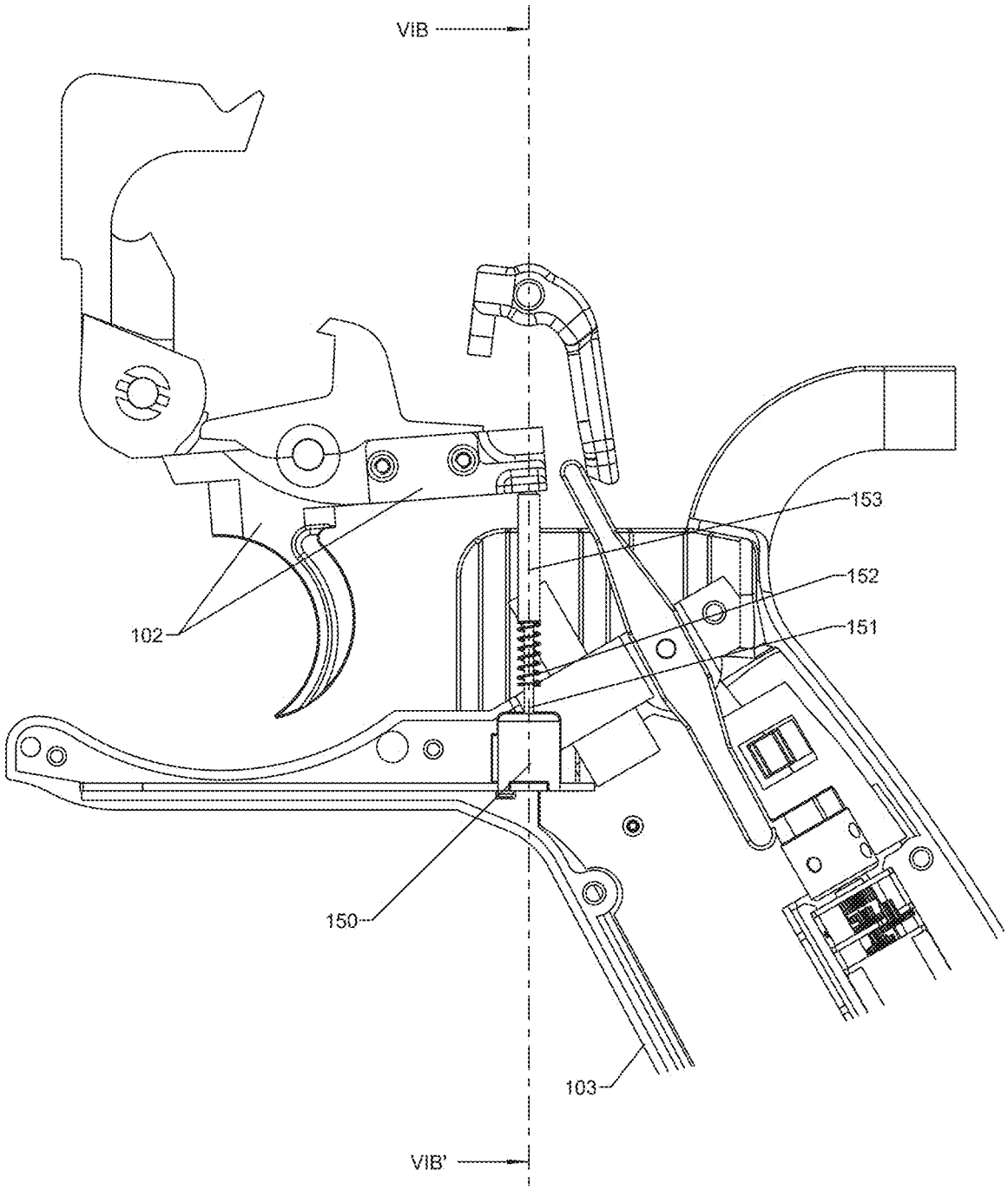
Figure 6A:
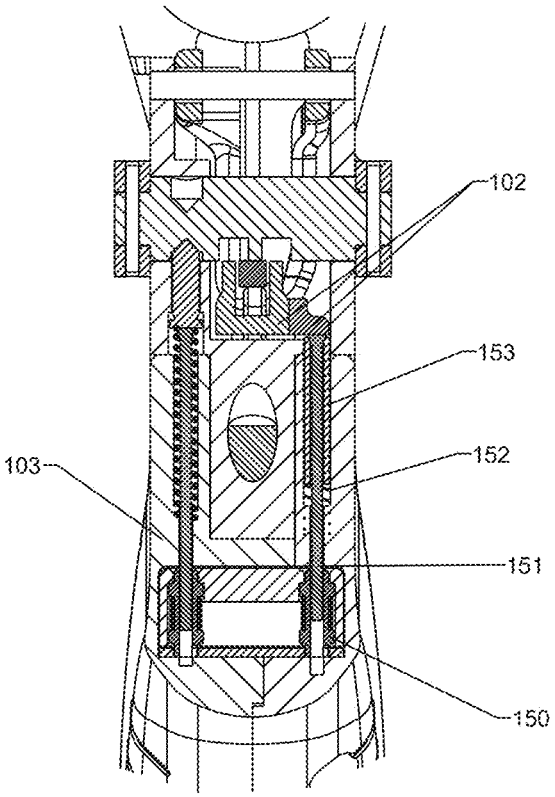
FIGS. 6A and 6B are cross sections along the lines VIA-VIA' and VIB-VIB' of FIGS. 5A and 5B, respectively.
Figure 6B:
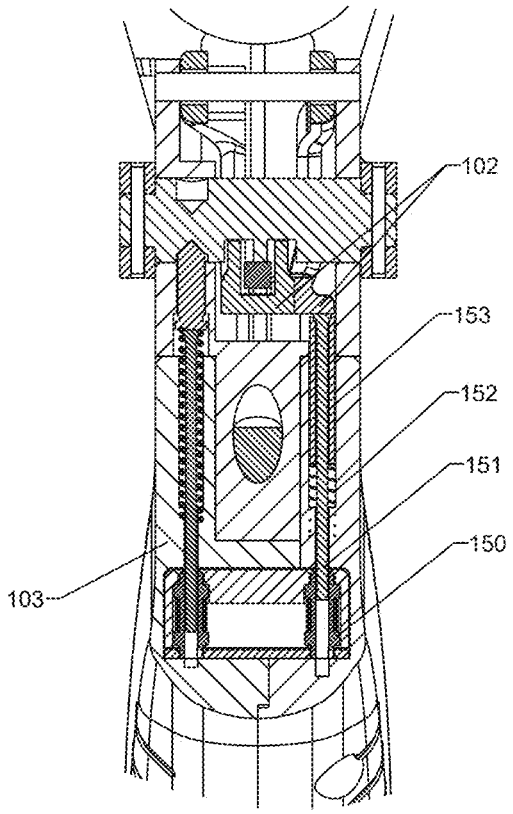

FIGS. 5-6 show in detail the trigger sensor (150) of the sear assembly (100), according to a preferred embodiment of the invention. The trigger sensor (150) is configured to determine if the trigger (102) is pulled. As previously described, the trigger sensor (150) comprises a coil. FIGS. 5A and 5B are left side views of the trigger sensor (150). FIG. 6A is a cross section along the line VIA-VIA' of FIG. 5A, and FIG. 6B is a cross section along the line VIB-VIB' of FIG. 5B.

FIGS. 5A and 6A show the trigger sensor (150) when the trigger (102) is not pulled and FIGS. 5B and 6B show the trigger sensor (150) when the trigger (102) is pulled. As can be seen, the trigger sensor (150) is a coil.

As may be seen as an exemplary embodiment in FIG. 5A, the trigger sensor (150) comprises a coil and a coil core (151) of a ferromagnetic material, preferably steel. Optionally, the trigger sensor (150) additionally comprises a coil core cap (153) and an elastic element, preferably a compression spring (152) between the coil core cap (153) and the grip (103), to bias the movement of the coil core cap (153) and the coil core (151). As illustrated in FIGS. 5-6 there is a direct physical contact between the trigger (102) and the coil core (151). In this way when the trigger (102) is pulled, the movement of the trigger (102) causes the movement of the coil core (151), while the trigger sensor (150) remains stationary, causing a variation in the core of the coil. As may be seen in FIG. 6A, when the trigger is not pulled, the coil core (151) is in its lowest position, the trigger sensor (150) having a value of inductance. When the trigger is pulled, shown in FIG. 6B, the coil core (151) moves to its highest position, being less coil core (151) inside the trigger sensor (150), causing a decrease in the inductance of the coil, making it possible to determine when the trigger (102) is or not being pulled. As shown for example in FIG. 5A, in a preferred embodiment, trigger sensor (150) is at least partially located in a grip (103) of the weapon.

As it will be described in relation to FIGS. 7-8, another important optionally characteristic of the present invention is that comprises a selector (160) operable at least between the firing state and the safe state of the sear assembly (100), and a selector sensor (170) for identifying the position of the selector (160), wherein the selector sensor (170) comprises a coil. As it has been described previously, the sear assembly (100) of the present invention comprises a safe state and a firing state. This firing state can be a semiautomatic firing state wherein the weapon releases only a shot when the trigger is pulled, or an automatic firing state, wherein the weapon releases multiple shots while the trigger is pulled.

The addition of the selector sensor (170) permits to know if the weapon is in the safe state, semiautomatic firing state or in the automatic firing state. In this way, the proposed invention allows to control the release of shots in both, the semiautomatic and the automatic firing state. A particularly important advantage of the present invention is that it allows, by controlling the interaction between the sear (110) and the hammer (101), to control and/or reduce the firing rate of the weapon.

Figure 7A:
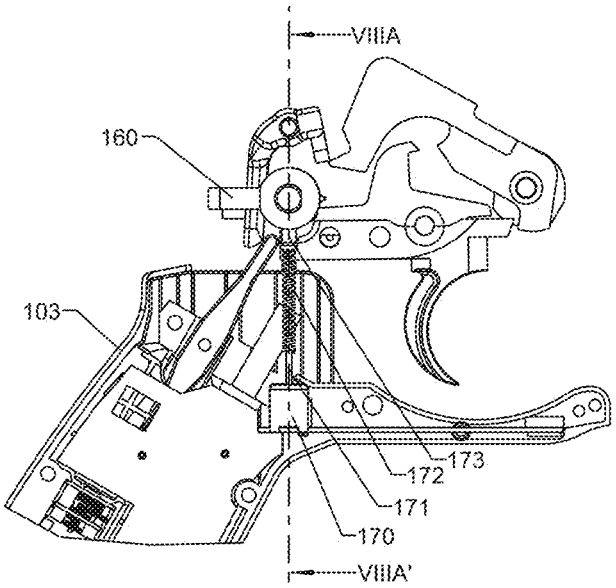
FIGS. 7A, 7B and 7C show right side views of the selector sensor according to a preferred embodiment of the present invention.
Figure 7B:
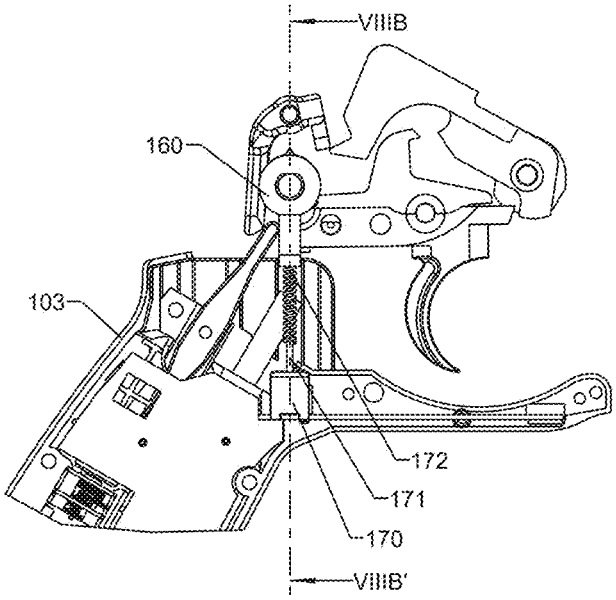
Figure 7C:
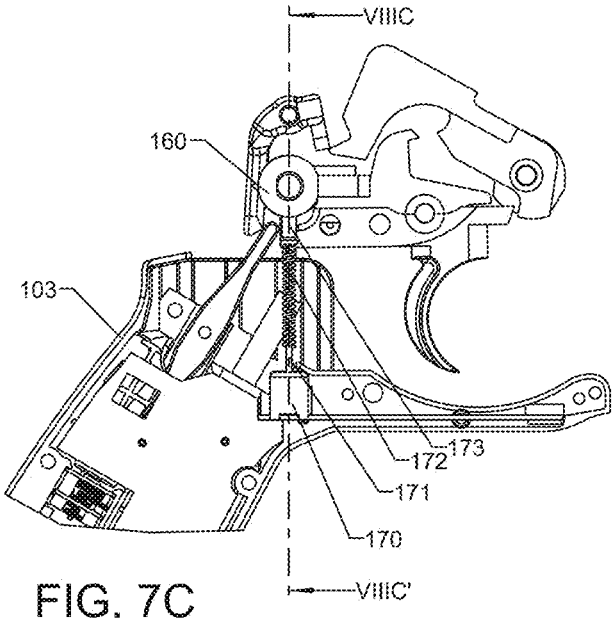
Figure 8A:
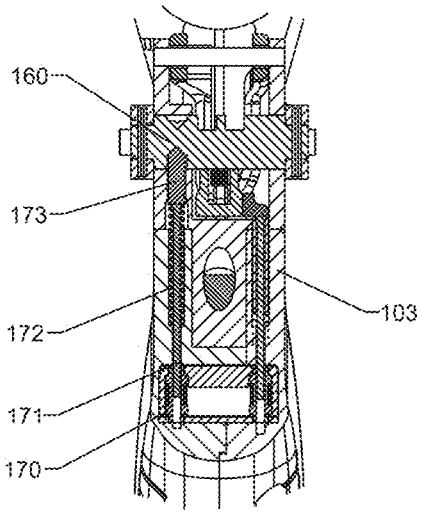
FIGS. 8A, 8B and 8C are cross sections along the lines VIIIA-VIIIA', VIIIB-VIIIB' and VIIIC-VIIIC' of FIGS. 7A, 7B and 7C, respectively.
Figure 8B:
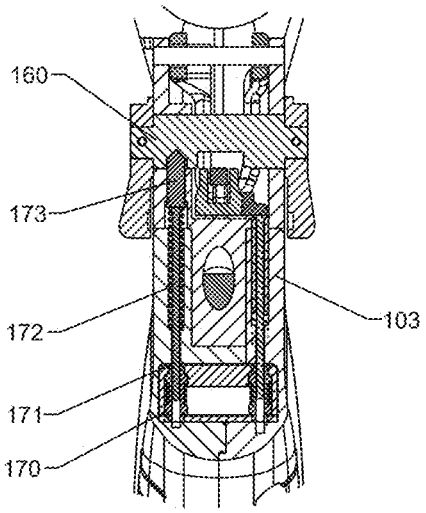
Figure 8C:
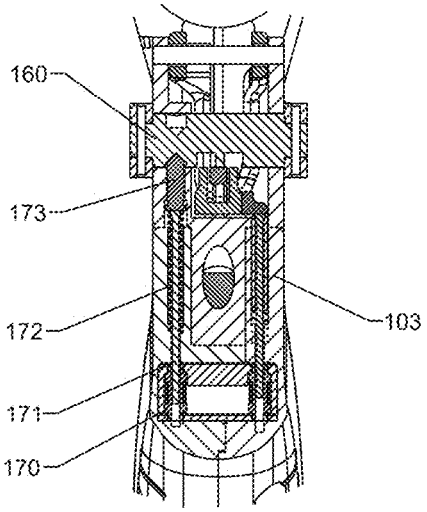

As previously introduced, FIGS. 7-8 show in detail the selector sensor (170) for identifying the position of the selector (160). FIGS. 7A, 7B and 7C are right side views of the selector sensor (170). FIG. 8A is a cross section along the line VIIIA-VIIIA' of FIG. 7A, and FIG. 8B is a cross section along the line VIIIB-VIIIB' of FIG. 7B, and FIG. 8C is a cross section along the line VIIIC-VIIIC' of FIG. 7C. FIGS. 7A and 8A show the selector sensor (170) when the selector (160) is in the safe state, FIGS. 7B and 8B show the selector sensor (170) when the selector (160) is in the semiautomatic firing state, and FIGS. 7C and 8C show the selector sensor (170) when the selector (160) is in the automatic firing state. As seen, the selector sensor (170) is a coil.

As can be seen as an exemplary embodiment in FIG. 7A, the selector sensor (170) comprises a coil and a coil core (171) of a ferromagnetic material, preferably steel. Optionally, the selector sensor (170) additionally comprises a selector detent (173) and an elastic element, preferably a compression spring (172) between the coil core (171) and the grip (103) to bias the movement of the coil core (171) and the selector detent (173). As it is illustrated in FIGS. 7-8, there is a direct physical contact between the selector (160) and the selector detent (173). Then, any movement in the selector (160) is transferred to the selector detent (173). Moreover, the selector detent (173) is in direct physical contact with the coil core (171) and translates any movement to it with the help of the compression spring (172). In this way, any movement of the selector (160) is transferred to a movement on the coil core (171). As the trigger sensor (150) remains always stationary, any movement of the selector (160) causes a variation in the core of the trigger sensor (170), that is to say, in the core of the coil and, as a result, in the inductance of the coil, making it possible to identify the position of the selector in any case. As may be seen in FIG. 8A, where the selector (160) is in the safe state of the sear mechanism (100), the coil core (171) is in its highest position. When the selector (160) is in the semiautomatic firing state, FIG. 8B, the coil core (171) is in a lower position than in the safe state, causing an increment in the value of the inductance of the selector sensor (170). Finally, when the selector (160) is in the automatic firing state, FIG. 8C, the coil core (171) is in its lowest position, being the position with the highest value of the inductance of the selector sensor (170). In this way, it is possible to know the position of the selector and to act in consequence. As shown for example in FIG. 7A, in a preferred embodiment, selector sensor (170) is at least partially located in a grip (103) of the weapon.

Figure 9A:
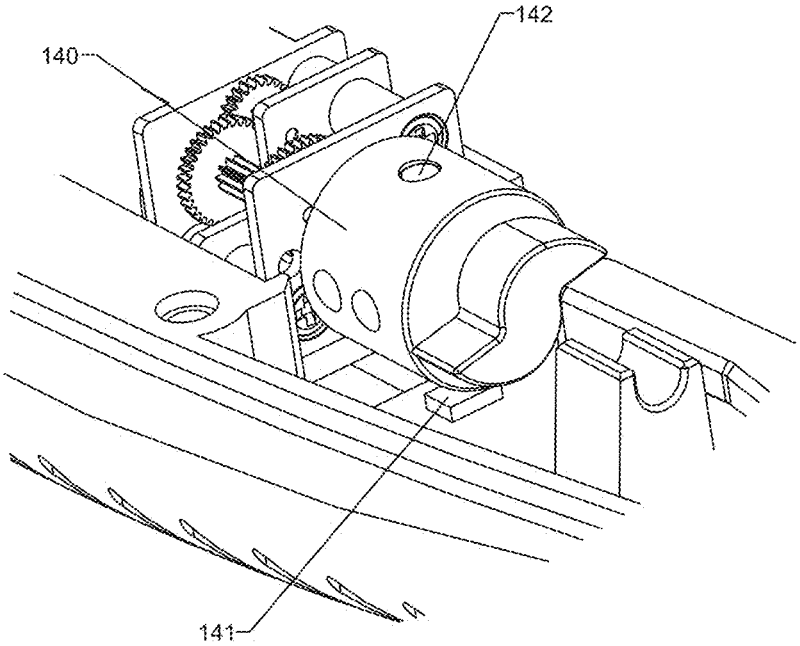
FIGS. 9A and 9B show a perspective view of the means for identifying the position of the cam when the sear assembly is in the safe state (FIG. 9A) and when the sear assembly is in the firing state (FIG. 9B).
Figure 9B:
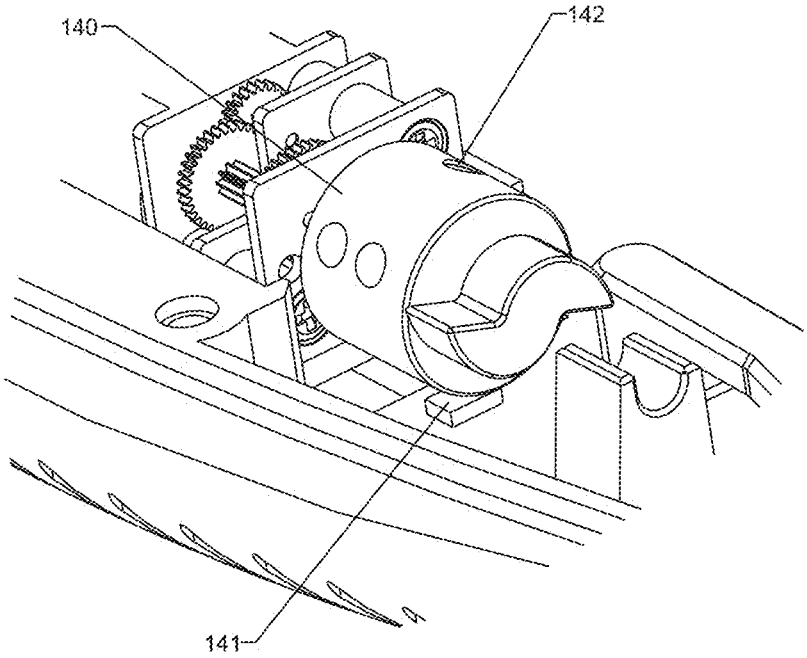

FIGS. 9A and 9B show that the present invention comprises means for identifying the position of the cam (140) by means of a hall sensor (141) associated with a magnet (142) established on the cam (140). FIG. 9A shows the hall sensor (141) and the magnet (142) when the sear assembly (100) is in the safe state, and FIG. 9B shows the hall sensor (141) and the magnet (142) when the sear assembly (100) is in the firing state. As may be seen, the position of the magnet (142) in the safe state changes respect to the position of the magnet (142) in the firing state, causing a variation in the intensity of the magnetic field that it is measured by the hall sensor (141), that remains stationary.

Figure 10:
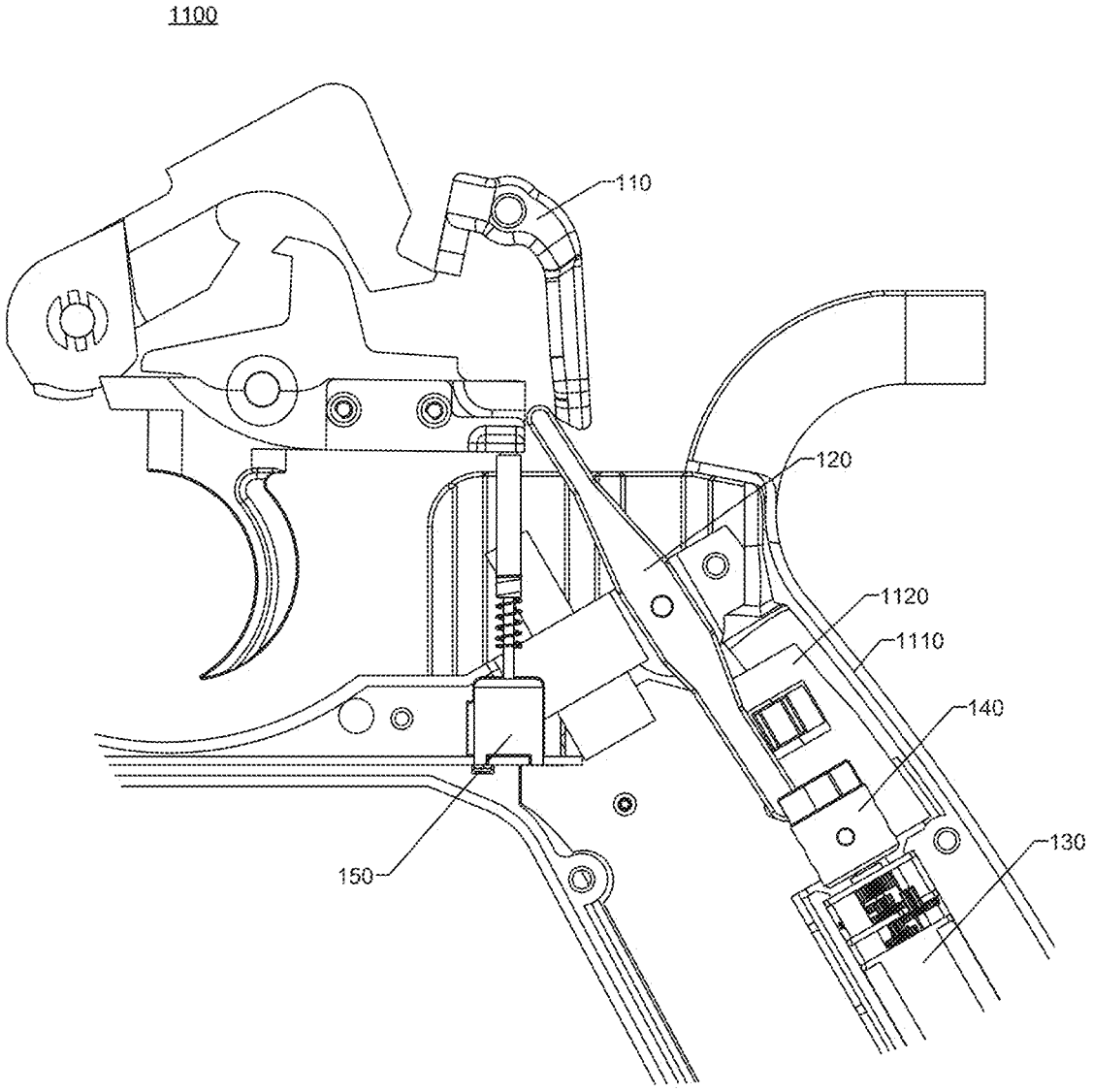
FIG. 10 shows a left side view with the electromechanical firing mechanism comprising the sear assembly according to a preferred embodiment of the present invention.

FIG. 10 shows an electromechanical firing mechanism (1100) according to the present invention suitable for a weapon. In the electromechanical firing mechanism (1100), the actuator (130) is powered by a power supply (such as a battery) housed in a grip (1110) of a weapon, where the rest of the control electronics (1120) are housed. The electronics (1120) can comprise selection means for performing selection between the firing state and the safe state of the sear assembly (100) and a processing unit to control the actuator (130) of the sear assembly (100) based on said selection. The electromechanical firing mechanism (1100) can comprise a battery.

Figure 11:
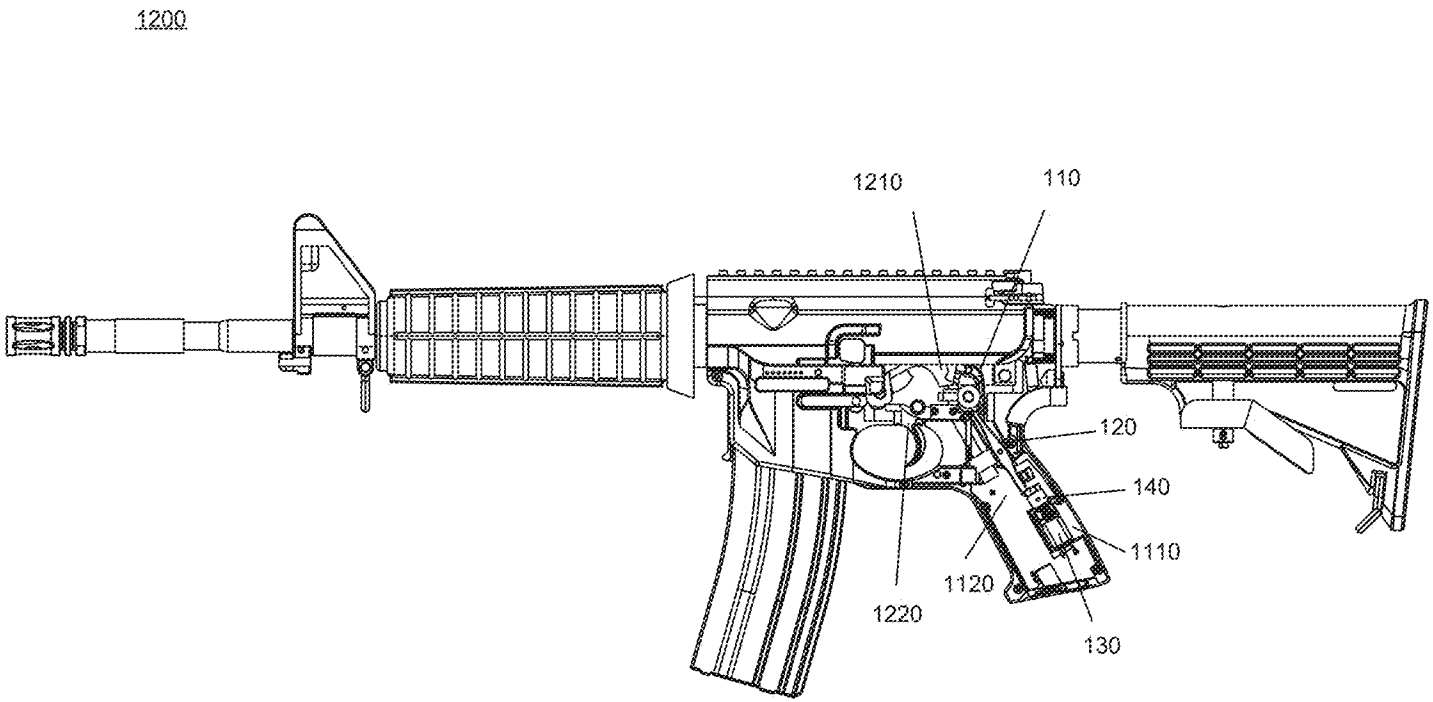
FIG. 11 shows a left side view of a weapon comprising the sear assembly according to the present invention.

FIG. 11 shows the weapon (1200) comprising the electromechanical firing mechanism (1100) according to the present invention that includes the sear assembly (100). Particularly it is shown the sear (110), the lever (120) mechanically coupled by one end to the sear (110) and the actuator (130) that actuates the lever (120) by means of a cam (140). It is also shown the electronics (1120) housed in the grip (1110). FIG. 11 also shows as part of the weapon (1200) the hammer (1210) and the trigger (1220).

In this text, the term "comprises" and its derivations (such as "comprising", etc.) should not be understood in an excluding sense, that is, these terms should not be interpreted as excluding the possibility that what is described and defined may include further elements, steps, etc. The invention is obviously not limited to the specific embodiments described herein, but also encompasses any variations that may be considered by any person skilled in the art within the general scope of the invention as defined in the claims.

The invention claimed is:

1. A sear assembly for a weapon, the weapon comprising a hammer adapted to contact with the sear assembly and a trigger disconnected from the sear assembly, wherein the sear assembly comprises:

a sear for mechanically engaging a sear surface on the hammer;

a lever mechanically coupled by one end to the sear, the lever comprising a contact surface that causes the rotation of the sear;

an actuator that actuates the lever by means of a cam; and a trigger sensor that is configured to determine if the trigger is pulled, wherein the trigger sensor comprises a coil, wherein the sear assembly comprises:

a firing state, wherein the actuator actuates the lever by means of the cam such that the contact surface of the lever causes the rotation of the sear in a counterclockwise direction, such that the sear disengages the sear surface on the hammer allowing at least a shot to be fired when pulling the trigger;

a safe state, wherein the actuator actuates the lever by means of the cam such that the contact surface of the lever causes the rotation of the sear in a clockwise direction, such that the sear engages the sear surface on the hammer impeding a shot to be fired when pulling the trigger.

2. The sear assembly of claim 1, which further comprises a selector operable at least between the firing state and the safe state of the sear assembly.

3. The sear assembly of claim 2, which further comprises a selector sensor for identifying the position of the selector.

4. The sear assembly according of claim 3, wherein the selector sensor comprises a coil.

5. The sear assembly of claim 3, wherein the trigger sensor and/or the selector sensor further comprises a coil core of a ferromagnetic material.

6. The sear assembly of claim 3, wherein the trigger sensor and/or the selector sensor are at least partially located in a grip of the weapon.

7. The sear assembly of claim 1, which further comprises means for identifying the position of the cam.

8. The sear assembly of claim 7, wherein the means for identifying the position of the cam comprises one or more magnetic field sensors, preferably hall sensors, associated with one or more magnetic elements established on the cam, preferably magnets or electromagnets.

9. The sear assembly of claim 1, wherein the actuator is a motor or an electromagnet.

10. The sear assembly of claim 1, wherein the actuator is located in the grip of the weapon.

11. The sear assembly of claim 1 for firing a weapon in an automatic mode.

12. The sear assembly of claim 1 for firing a weapon in a semi-automatic mode.

13. A weapon comprising the sear assembly of claim 1.

14. A method for selecting between a firing state or a safe state of a sear assembly for a weapon, the weapon comprising a hammer adapted to contact with the sear assembly and a trigger disconnected from the sear assembly, the sear assembly comprising:

a sear for mechanically engaging a sear surface on the hammer;

a lever mechanically coupled by one end to the sear, the lever comprising a contact surface that causes the rotation of the sear;

an actuator that actuates the lever by means of a cam; and a trigger sensor that is configured to determine if the trigger is pulled, wherein the trigger sensor comprises a coil, the method comprising:

selecting the firing state of the sear assembly, wherein in the firing state, the actuator actuates the lever by means of the cam such that the contact surface of the lever causes the rotation of the sear in a counterclockwise direction, such that the sear disengages the sear surface on the hammer allowing at least a shot to be fired when pulling the trigger;

or selecting the safe state of the sear assembly, wherein in the safe state, the actuator actuates the lever by means of the cam such that the contact surface of the lever causes the rotation of the sear in a clockwise direction, such that the sear engages the sear surface on the hammer impeding a shot to be fired when pulling the trigger.

15. The sear assembly of claim 4, wherein the trigger sensor and/or the selector sensor further comprises a coil core of a ferromagnetic material, preferably steel.

16. The sear assembly of claim 4, wherein the trigger sensor and/or the selector sensor are at least partially located in a grip of the weapon.

17. The sear assembly of claim 5, wherein the trigger sensor and/or the selector sensor are at least partially located in a grip of the weapon.

18. The sear assembly of claim 1, configured for enabling firing of the weapon in both an automatic mode and in a semiautomatic mode.

19. The weapon of claim 14, wherein the weapon comprises an only sear for firing in automatic or semiautomatic mode.

20. The weapon of claim 14, the weapon comprising an electromechanical firing mechanism, the electromechanical firing mechanism comprising:

the sear assembly;

electronics comprising selection means for performing selection between the firing state and the safe state of the sear assembly;

a processing unit to control the actuator based on said selection; and a battery.

* * * * *